US005716240A

United States Patent [19]

Harada

[11] Patent Number: 5,716,240

[45] Date of Patent: Feb. 10, 1998

[54] WEDGE-BASE BULB SOCKET

[75] Inventor: Tadashi Harada, Shizuoka, Japan

[73] Assignee: Koito Manufacturing Co., Ltd., Tokyo, Japan

[21] Appl. No.: 688,791

[22] Filed: Jul. 31, 1996

[30] Foreign Application Priority Data

Aug. 10, 1995 [JP] Japan ..... 7-224523

[51] Int. Cl.[6] ..... H01R 17/00

[52] U.S. Cl. ..... 439/699.2

[58] Field of Search ..... 439/699.2, 918, 439/360, 385

[56] References Cited

U.S. PATENT DOCUMENTS

| | | | |
|---|---|---|---|
| 5,035,643 | 7/1991 | Forish et al. | 439/699.2 |
| 5,286,223 | 2/1994 | Ogawa | 439/699.2 |
| 5,507,670 | 4/1996 | Ogawa | 439/699.2 |

*Primary Examiner*—Neil Abrams
*Assistant Examiner*—Yong Ki Kim
*Attorney, Agent, or Firm*—Sughrue, Mion, Zinn, Macpeak & Seas, PLLC

[57] ABSTRACT

A wedge-base bulb socket which fixedly holds a wedge-base bulb and prevents it from rattling when the bulb is fitted to the wedge-base bulb socket, as well as prevents terminals provided in the socket from rattling. A bulb insertion hole is formed in a bulb socket portion so as to open at one end, and the hole is surrounded by a wall. Terminal strip holding portions are formed along an interior surface of the wall. Socket terminals are formed so as to be integral with terminal strips for establishing electrical connection with a base of a wedge-base bulb as well as fixedly holding the same. Power feeding terminal sections are formed so as to be integral with the terminal strips for electrical connections to the outside. The socket terminals of the terminal stripes are disposed in the bulb insertion hole of the bulb socket portion, and the power feeding terminal sections are disposed in a power feeding connector, whereby part of the socket terminals are sandwiched between the terminal strip holding portions of the bulb socket and the wall.

14 Claims, 10 Drawing Sheets

WEDGE-BASE BULB SOCKET

BACKGROUND OF THE INVENTION

The present invention relates to a wedge-base bulb socket. More particularly, the present invention relates to a wedge-base bulb socket which fixedly holds a wedge-base bulb and prevents it, as well as to terminals provided in the socket, from rattling.

For bulbs used as the light source of a vehicular lamp, there is known a so-called wedge-base bulb, which has no cap. To attach the wedge-base bulb to the lamp, the base of a glass bulb is directly inserted into a socket.

FIGS. 19 and 20 show an example of a conventional wedge-base bulb and wedge-base bulb socket to which the wedge-base bulb is connected.

A wedge-base bulb "a" is a so-called double filament bulb having two filaments. The wedge-base bulb "a" has a glass bulb "b", a substantially oblate base "c" projecting downward from the glass bulb "a", leads "d" extending from the lower end of the base "c", and terminals "e" formed by bending one of the leads "d" rightward and the other leftward and by further upwardly folding the leads along the side surface of the base "c".

A socket "f" includes a socket body "g" and terminal strips (described later). The socket body "g" has a bulb socket "h", and terminal strips "j", "k", and "l" are disposed along the interior surface of a bulb insertion hole "i" of the bulb socket "h". One end of each of the terminal strips "j", "k", and "l" is connected to a power cord or the like as required. As a result, the terminal strips are electrically connected to the power supply of the automobile.

The terminal strip "k" is provided with a pressing protuberance "m" for pressing the base "c" of the wedge-base bulb "a" in the direction in which the filaments extend.

When the base "c" of the bulb "a" is inserted into the bulb insertion hole "i" of the socket "f", the base "c" is held as if caught in the terminal strips "j", "k", and "1" At the same time, the base "c" comes into contact with the terminals "e" individually, whereby electrical power is fed to the bulb "a".

It is necessary for the wedge-base bulb socket "f" to fixedly hold the base "c" of the wedge-base bulb "a" while it is inserted into the bulb insertion hole "i" of the wedge-base bulb socket "f" to prevent the bulb "a" from rattling or becoming dislodged.

In practice, the base "c" is principally sandwiched between the terminal strips "j", "k", and"l" of the socket "f" while the bulb "a" is inserted into the bulb insertion hole "i". The pressing protuberance "m" presses only one side of the bulb in the direction in which the filaments extend. Accordingly, the bulb is likely to experience vibration, and the like, whereby the bulb "a" rattles in the direction in which the filaments extend. In the event of high levels of vibration, the luminous intensity distribution pattern of the lamp can get out of alignment.

Further, the terminal strips "j", "k", and "l" are not fixed in the bulb insertion hole "i", but are simply disposed along the interior surface of the bulb insertion hole "i". Therefore, the terminal strips "j", "k", and themselves may also rattle in the bulb insertion hole "i".

SUMMARY OF THE INVENTION

To solve the previously described drawbacks in the prior art, according to one aspect of the present invention, there is provided a wedge-base bulb socket including a socket body integrally comprising a bulb socket portion and a power feeding socket portion, and at least three terminal strips. A bulb insertion hole is formed in the bulb socket portion opening at one end and surrounded by a wall. Terminal strip holding portions are formed along the interior surface of the wall. The terminal strips are formed by the integration of a socket terminal section for making electrical connection to and holding a base of the wedge-base bulb and a power feeding terminal section for establishing electrical connection to the outside. The socket terminal sections are disposed within a bulb insertion hole of the bulb socket portion, and the power feeding terminal sections are disposed in a power feeding connector. Part of the socket terminal sections are sandwiched between the terminal strip holding portions and the wall.

By means of the wedge-base bulb socket of the present invention, the socket terminals of the terminal strips are sandwiched between the terminal strip holding portions of the bulb socket and the wall, which makes it possible to prevent the terminal strips from rattling. It is also possible to prevent rattling of the bulb itself and breaks in the filaments caused as a result of rattling of the terminal strips.

DESCRIPTION OF THE PREFERRED EMBODIMENTS

The detailed construction of a wedge-base bulb socket according to the present invention will be described hereinbelow with reference to an illustrative embodiment shown in FIGS. 1 through 8.

A wedge-base bulb socket 1 holds at one end thereof a wedge-base bulb (described later), and the other end of the wedge-base bulb socket 1 is connected to a power connector (not shown). The wedge-base bulb socket 1 includes the socket body and a plurality of terminal strips disposed in the socket body.

Figure 1:
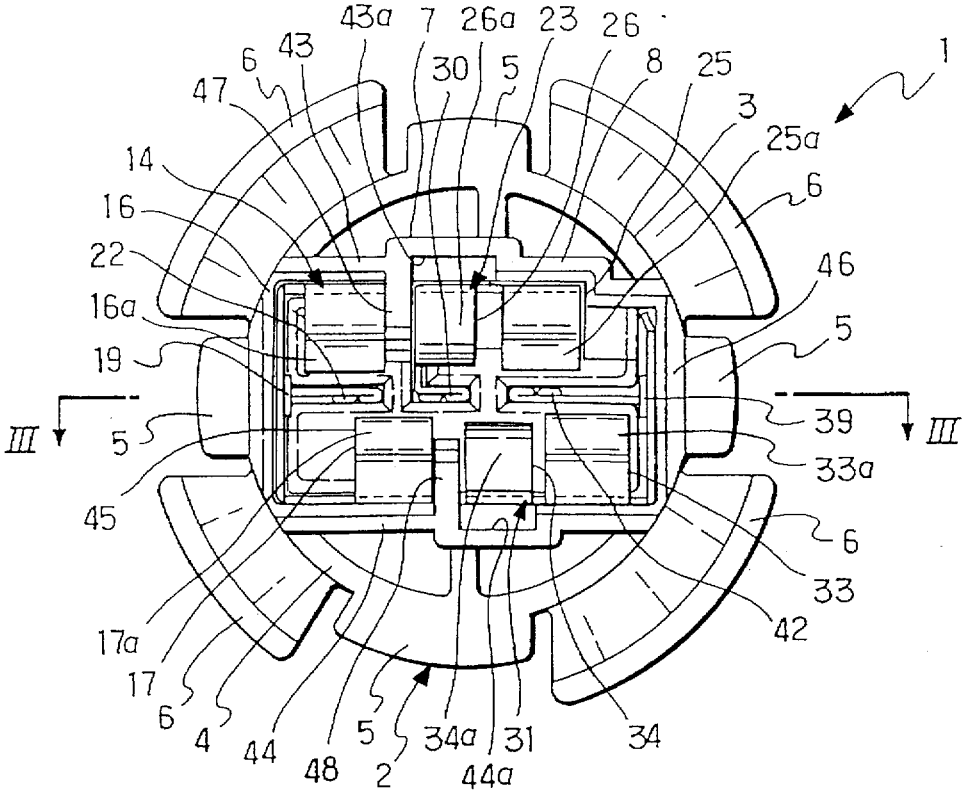
FIG. 1 is a front view of a wedge-base bulb socket constructed according to a preferred embodiment of the present invention.
Figure 3:
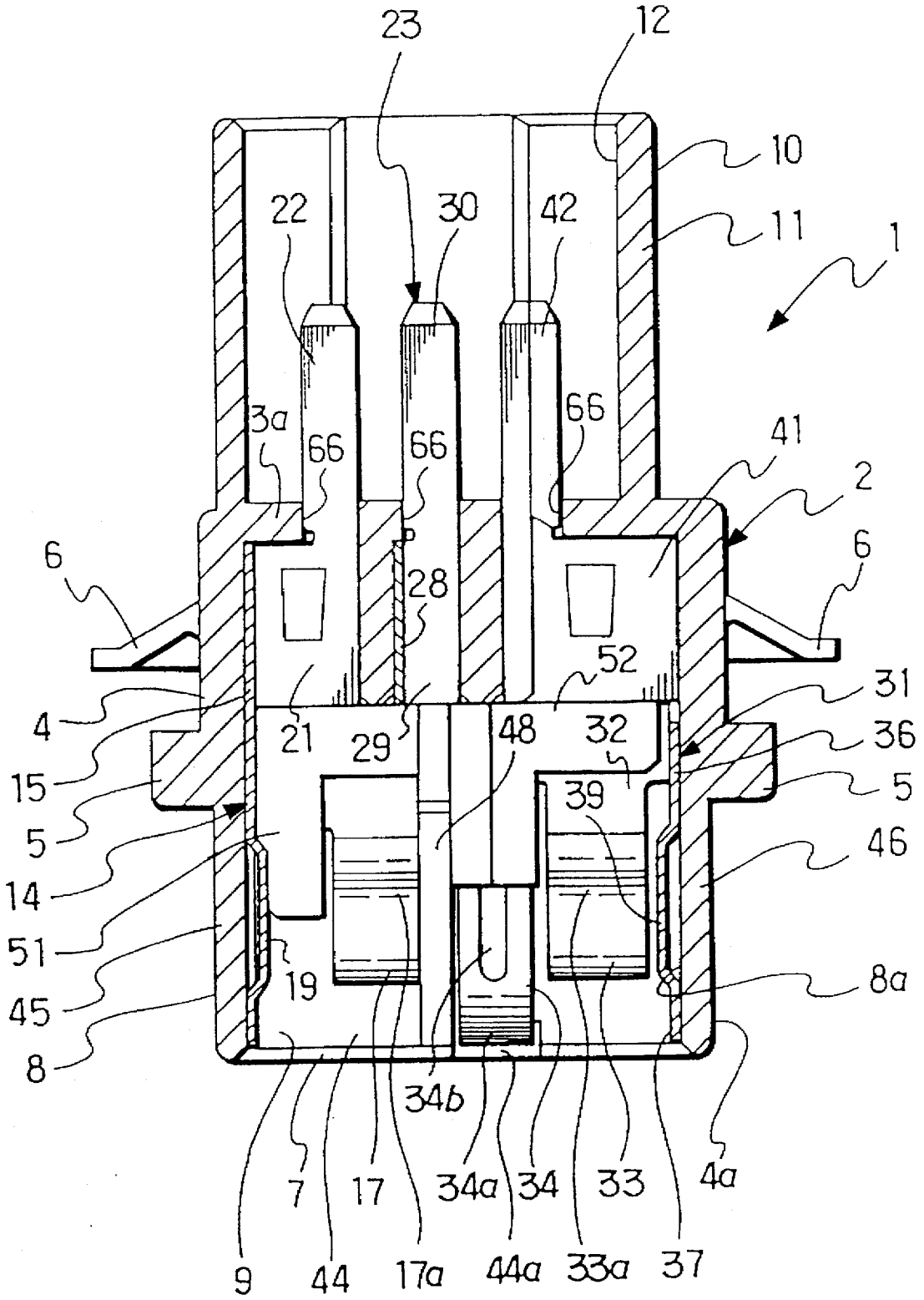
FIG. 3 is a cross-sectional view of the wedge-base bulb socket taken along line III—III shown in FIG. 1.

For convenience of explanation but without limitation on the scope of the invention, the upward, downward, leftward, and rightward directions in FIG. 1 are used herein to define the upward, downward, leftward, and rightward directions of the wedge-base bulb socket. Further, the upward and downward directions (the longitudinal direction of the socket body) shown in FIG. 3 are used herein to define the rearward and forward directions of the wedge base socket bulb, respectively.

A socket body 2 is molded from a dielectric material such as a synthetic resin. The socket body 2 has a substantially cylindrical main portion 3. One end of the cylindrical main portion 3 opens in the forward direction, while its rear end is closed. An angularly cylindrical bulb socket (described later) forwardly projects from a rear end wall 3*a* of the main portion 3 in an integrated fashion. A cylindrical power feeding connector projects rearward from the rear end wall 3*a* in an integrated fashion.

Lock projections 5 radially project from the vicinity of the front end of a circumferential wall 4 of the main portion 3 in an integrated fashion, circumferentially spaced substantially at an angle of 90° from each other. Further, a flange 6 integrally projects from the circumferential wall 4 in a slightly rearward position with respect to the lock projections 5.

The flange 6 projects from an outer peripheral surface 4*a* of the circumferential wall 4 of the main portion 3 at an angle in the forward direction, namely, it radially projects at an angle from the outer peripheral surface 4*a* in the forward direction. A rim extends from the outermost edge of the tapered portion of the flange 6 in the direction orthogonal to the outer peripheral surface 4*a*.

The flange 6 is divided into four subdivisions, and they are circumferentially spaced apart from each other at intervals which are slightly larger than the circumferential width of the lock projection 5 in such a way as not to overlap with the lock projections 5 in the forward direction.

The bulb socket 7 forwardly projects from the rear end wall 3*a* of the main portion 3, and it is surrounded by a wall 8. The bulb socket 7 is formed into a substantially angularly cylindrical shape, and a bulb insertion hole 9 opens in the front end of the bulb socket 7. Part of terminal strips (described later) are disposed along an interior surface 8*a* of the wall 8 within the bulb insertion hole 9. The rear end of the wall 8 is situated within the main portion 3, as well as partially overlapping the circumferential wall 4 of the main portion 3. Therefore, the wall 8 of the substantially rectangular parallelepiped bulb socket 7 is situated within the peripheral wall 4 of the substantially cylindrical main portion 3, thereby constituting a double structure.

A power feeding connector 10 projects rearward from the rear end wall 3*a* of the main portion 3. Like the bulb socket 7, the power feeding connector 10 is surrounded by a wall 11. The power feeding connector 10 has a connector insertion hole 12, which opens in the rearward direction, and it forms a substantially projecting cylindrical element when viewed from in the direction in which the connector insertion hole 12 opens.

Specifically, a center portion 13 of an upper wall of the wall 11 is raised further in the radial direction compared with the other area of the wall, thereby constituting a C-shaped projection. As a result, the connector insertion hole 12 has a projecting profile. The connector insertion hole 12 acts as a guide groove for positioning a power connector (not shown) inserted into the bulb socket.

Three terminal strips formed from a conductive spring-type metal plate are fixedly inserted into the socket body 2. As will be described later, these three terminal strips are different from each other in shape.

Figure 7:
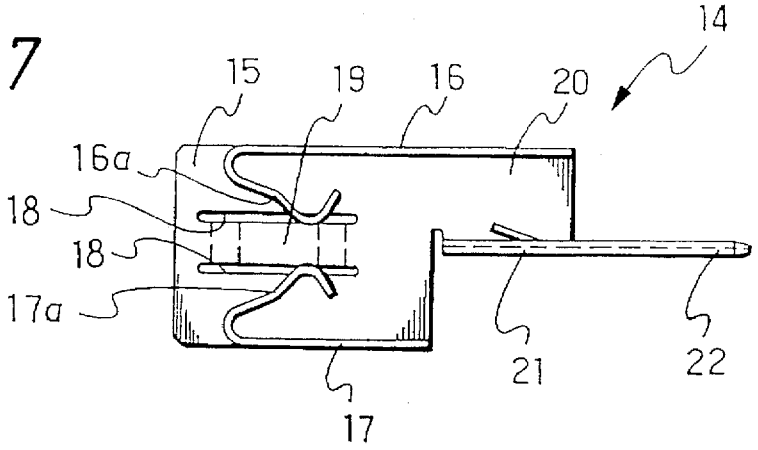
FIG. 7 is a right side view of a first terminal strip.
Figure 8:
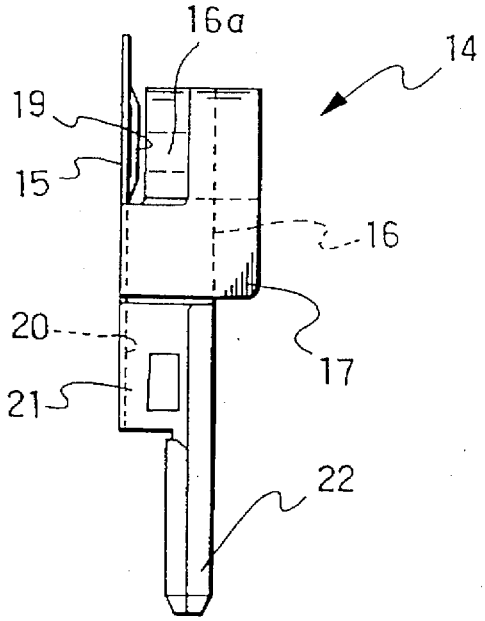
FIG. 8 is a bottom view of the first terminal strip shown in FIG. 7.
Figure 9:
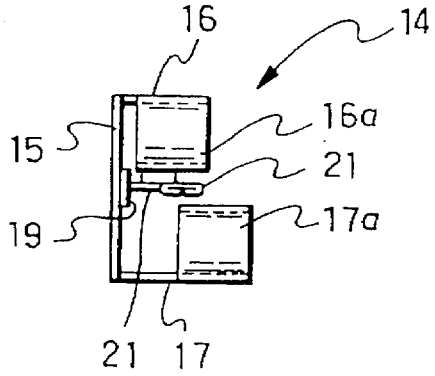
FIG. 9 is a front view of the first terminal strip shown in FIG. 7.

As shown in FIGS. 7 through 9, a first terminal strip 14 has a main portion 15 which extends vertically, the main portion 15 being shaped like a letter L laid sideways when viewed in the direction orthogonal to the wide surface thereof. Socket terminal sections 16 and 17 integrally project from the respective upper and lower edges of the main portion 15 in a horizontal direction.

The socket terminal sections 16 and 17 project rightward from the main portion 15 in different lengths. Specifically, the lower socket terminal section 17 projects about 1.5 times longer than the upper socket terminal section 16.

Socket terminals 16*a* and 17*a* extend from the right ends of the upper and lower socket terminal sections 16 and 17, respectively. The socket terminals 16*a* and 17*a* have front ends respectively bent gently downward and upward in hairpin style. Further, they extend rearward so as to be arranged in an offset relationship with each other in the vertical direction of the main portion.

As shown in FIG. 7, the socket terminals 16*a* and 17*a* extend at an angle from the socket terminal sections 16 and 17 in the downward and upward directions, respectively. The angle of inclination increases at the middle portion of each of the socket terminals 16 and 17. The rear end portions following the middle portions are curved in the shape of circular arc, so that the outermost ends of the socket terminals are respectively directed upwards and downwards at predetermined angles.

Two slits 18 are formed in the vertical middle of the main portion 15 so as to longitudinally extend parallel to each other. An area 19 sandwiched between the slits is raised rightward in substantially the form of a trapezoid. As will be described in more detail later, the trapezoidal protuberance 19 comes into contact with part of the wedge-base bulb, whereby the wedge-base bulb is fixedly positioned. The trapezoidal protuberance 19 serves as a regulating piece for regulating the movement of the wedge-base bulb.

A rear end portion 20 extends rearward from the main portion 15, and a power feeding terminal section 21 integrally extends from the lower edge of the rear end portion 20 in the horizontal direction. The rear end of the power feeding terminal section 21 further extends in the rearward direction so as to form a power feeding terminal 22. The right and left edges of the power feeding terminal 22 are folded downward. The thus-folded edges butt against each other under the lower surface of the power feeding terminal along its longitudinal center. As a result, the power feeding terminal 22 has a double structure, which results in the strength of the power feeding terminal being increased.

Figure 10:
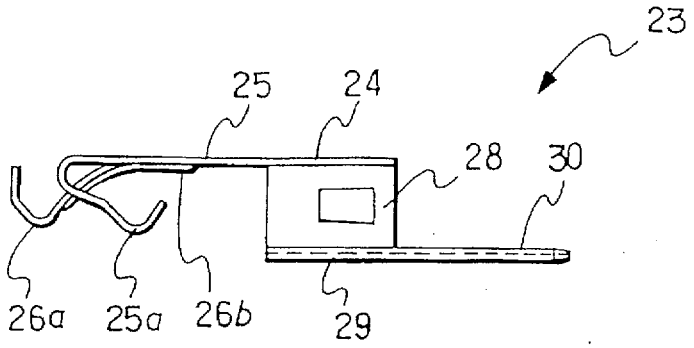
FIG. 10 is a right side view of a second terminal strip.
Figure 11:
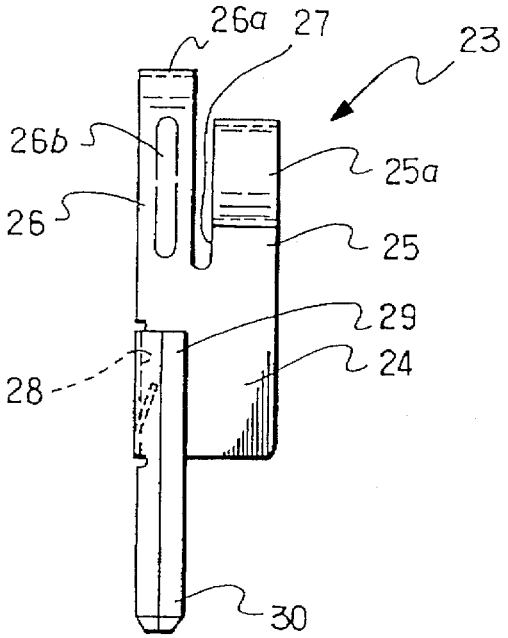
FIG. 11 is a bottom view of the second terminal strip shown in FIG. 10.
Figure 12:
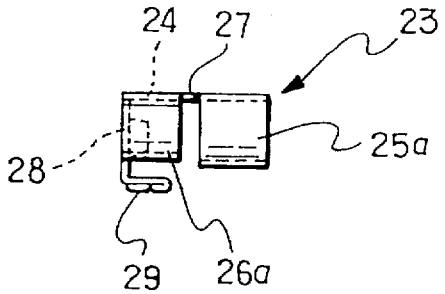
FIG. 12 is a front view of the second terminal strip shown in FIG. 10.

As shown in FIGS. 10 through 12, a second terminal strip 23 has a substantially rectangular parallelepiped main portion 24 which horizontally extends in the longitudinal direction of the second terminal strip 23. A socket terminal section 25 and a holding section 26 extend side by side from the front edge of the main portion 24 in an integrated fashion. The socket terminal section 25 and the holding section 26 are separated from each other by a gap 27 formed between them.

A socket terminal 25*a* extends from the front end of the socket terminal section 25 in an integrated fashion. That is, the socket terminal 25*a* is gently bent in the downward direction in hairpin style and then extends rearward.

Specifically, like the previously described socket terminals 16*a* and 17*a* of the first terminal strip 14, the socket terminal 25*a* extends downward from the front edge of the main portion 24 at an angle, and the angle of inclination increases from the middle portion of the socket terminal 25*a*. The rear portion following the middle portion curves in the shape of circular arc, and the rear edge is upwardly inclined.

The holding section 26 is gradually bent in the downward direction at a predetermined angle, and the front distal end of the bent portion is straightened upward so as to form a hook-shaped holding piece 26*a*. In other words, the holding piece 26*a* is first bent downward in the forward direction thereof, as shown in FIG. 10. Subsequently, it is bent upward at an angle, and the edge of the upward bent portion is straightened up.

A bead 26*b* is formed in the holding section 26 by pressing. The bead 26*b* is formed so as to stretch from the base of the holding section adjoining to the main portion 24 to the downward inclined portion of the holding piece 26*a*. As a result, the rigidity of the holding section 26 is increased, whereby a stable spring force is ensured. Therefore, in the event that the holding section 26 is repeatedly bent, it is protected from deformation and fracture as much as possible.

A joint 28 extends downward from the left edge of the rear of the main portion 24 in an integrated fashion. A power feeding terminal section 29 integrally extends from the lower edge of the joint 28 in the horizontally rightward direction.

The rear end of the power feeding terminal section 29 further extends in the rearward direction so as to form a power feeding terminal 30. The right and left edges of the power feeding terminal 30 are folded downward, and the thus folded edges butt against each other along the longitudinal center line under the lower surface of the power feeding terminal. As a result, the power feeding terminal has a double structure, which results in the strength of power feeding terminal being increased.

Figure 13:
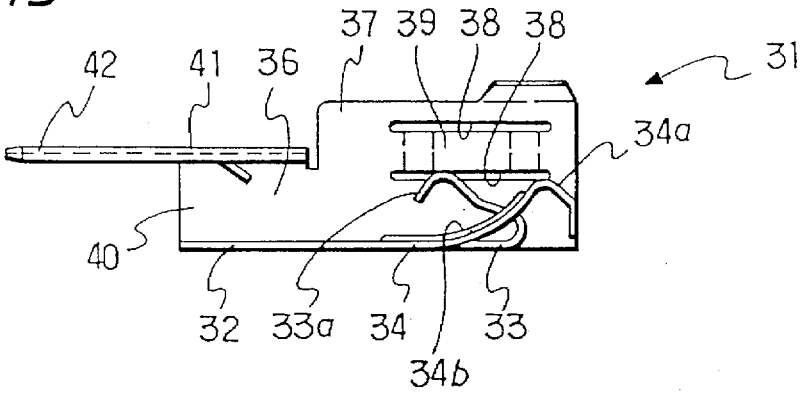
FIG. 13 is a left side view of a third terminal strip.
Figure 14:
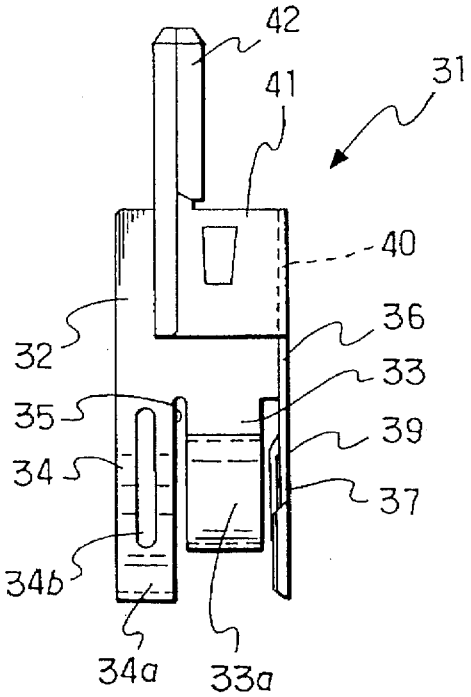
FIG. 14 is a plan view of the third terminal strip shown in FIG. 13.
Figure 15:
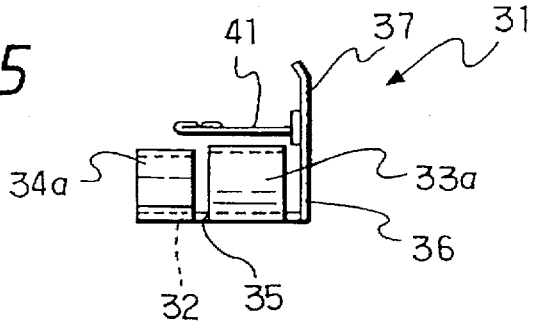
FIG. 15 is a front view of the third terminal strip shown in FIG. 13.
Figure 16:
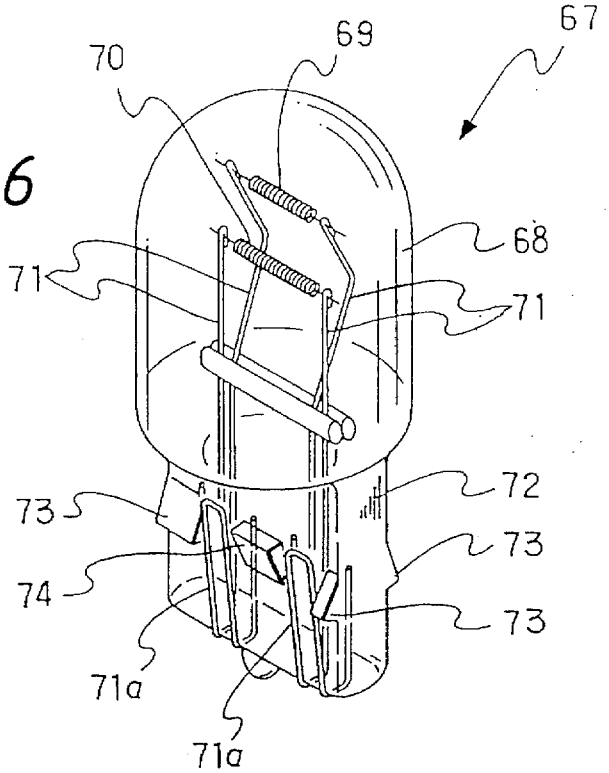
FIG. 16 is a perspective view of a wedge-base bulb.

As shown in FIGS. 13 through 15, a third terminal strip 31 is composed of a substantially rectangular parallelepiped main portion 32 which extends horizontally in the longitudinal direction of the third terminal strip. A socket terminal section 33 and a holding section 34 integrally extend, side by side, from the front edge of the main portion 32. The socket terminal section 33 and the holding section 34 are separated from each other by a gap 35 formed between them.

A socket terminal 33*a* integrally extends from the front edge of the socket terminal section 33 in the rearward direction. The socket terminal 33*a* gently curves in the upward direction in hairpin style.

As shown in FIG. 13, the socket terminal 33*a* extends upward from the front edge of the main portion 32 at an angle. The angle of inclination increases from the middle portion of the socket terminal 33*a*. The rear portion following the middle portion curves in the form of circular arc, and the rear edge is inclined downward.

The holding section 34 gradually curves in the upward direction, so that the front edge of the holding section 34 is formed into a hook-shaped holding piece 34*a*. At the start, the holding piece 34*a* extends upward at an angle in the forward direction of the socket terminal. The holding piece 34*a* then curves downward, and the edge of the holding piece 34*a* is bent straight in the downward direction.

Like the second terminal strip 23, a bead 34*b* is formed in the holding section 34 by pressing. The bead 34*b* is formed so as to stretch from the base of the holding section 34 adjoining the main portion 32 to the upwardly inclined portion of the holding piece 34*a*. As a result, the rigidity of the holding section 34 is increased, whereby a stable spring force is ensured. Therefore, in the event that the holding section 34 is repeatedly bent, it is protected from deformation and fracture as much as possible.

A joint 36 integrally extends from the right edge of the main portion 32 in the upward direction. An area 37 of the joint 36, which is close to the front edge of the third terminal strip, extends forward to substantially the same position where the front edge of the holding piece 34*a* is situated.

Two slits 38 are formed in the vertically middle position on the area 37 extending in the horizontally longitudinal direction. The region sandwiched between the slits 38 is raised leftward into substantially the shape of a trapezoid. As will be described in more detail later, the trapezoidal ridge forms a regulating leaf 39 which comes into contact with part of the wedge-base bulb so as to press one of both sides thereof, whereby movement of the wedge-base bulb is controlled.

A power feeding terminal section 41 extends horizontally from the upper edge of an area 40 of the joint 36 close to the rear edge of the third terminal strip. Specifically, the power feeding terminal section 41 is bent leftward at a right angle along the upper edge of the area 40, which is substantially on a level with the vertical middle of the third terminal strip. The rear end of the power feeding terminal section 41 extends further rearward so as to form a power feeding terminal 42. Both edges of the power feeding terminal 42 are bent downward, and the thus-bent edges butt against each other along the longitudinal center of power feeding terminal strip under the lower surface thereof. As a result, power feeding terminal strip has a double structure, which results in the strength of the power feeding terminal being increased.

The internal configuration of the bulb insertion hole 9 will now be described.

The wall 8 of the bulb socket 7 which defines the bulb insertion hole 9 includes an upper wall 43, a lower wall 44, a left wall 45, and a right wall 46. Terminal strip holding sections and slits are formed so as to extend forward from the rear end wall 3*a* of the main portion 3 along the interior surface of the walls 43, 44, 45, and 46 in order to retain the first terminal strip 14, the second terminal strip 23, and the third terminal strip 31.

As shown in FIGS. 3 through 6, ribs 47 and 48 are integrally raised from the respective interior surfaces of the upper wall 43 and the lower wall 44 of the wall 8, that is, the interior surface 8*a* of the wall 8, so as to extend longitudinally. Specifically, the rib 47 extends downward from a leftward position on the upper wall 43, whereas the rib 48 rises upward from substantially the center of the lower wall 44.

The ribs 47 and 48 extend rearward along the wall 8 so as to connect to the rear end wall 3*a* of the main portion 3.

Figure 5:
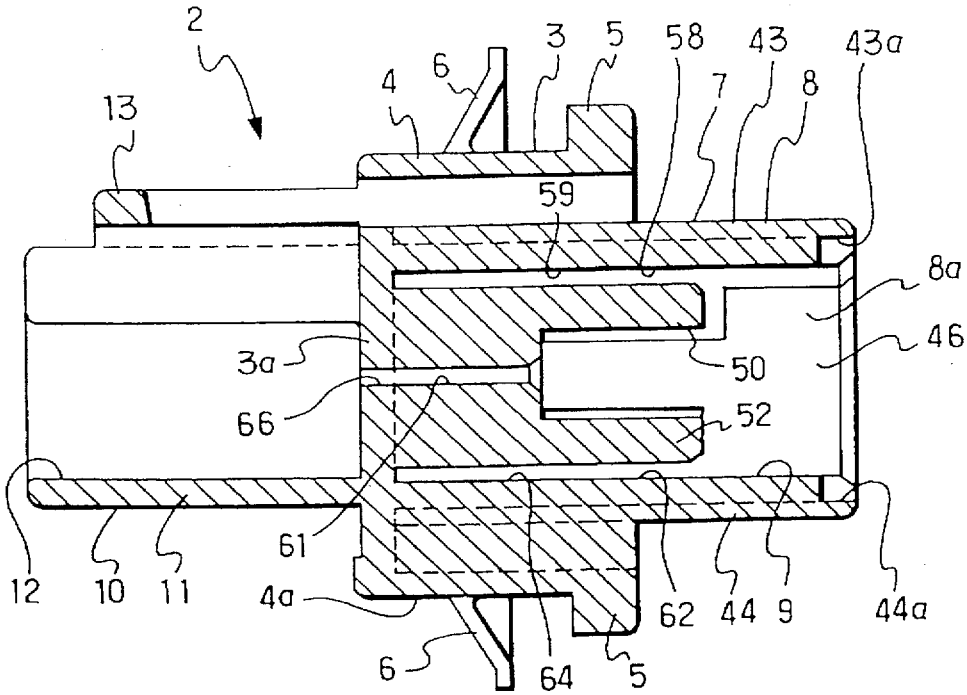
FIG. 5 is a cross-sectional view of the socket body taken along line V—V shown in FIG. 4.
Figure 6:
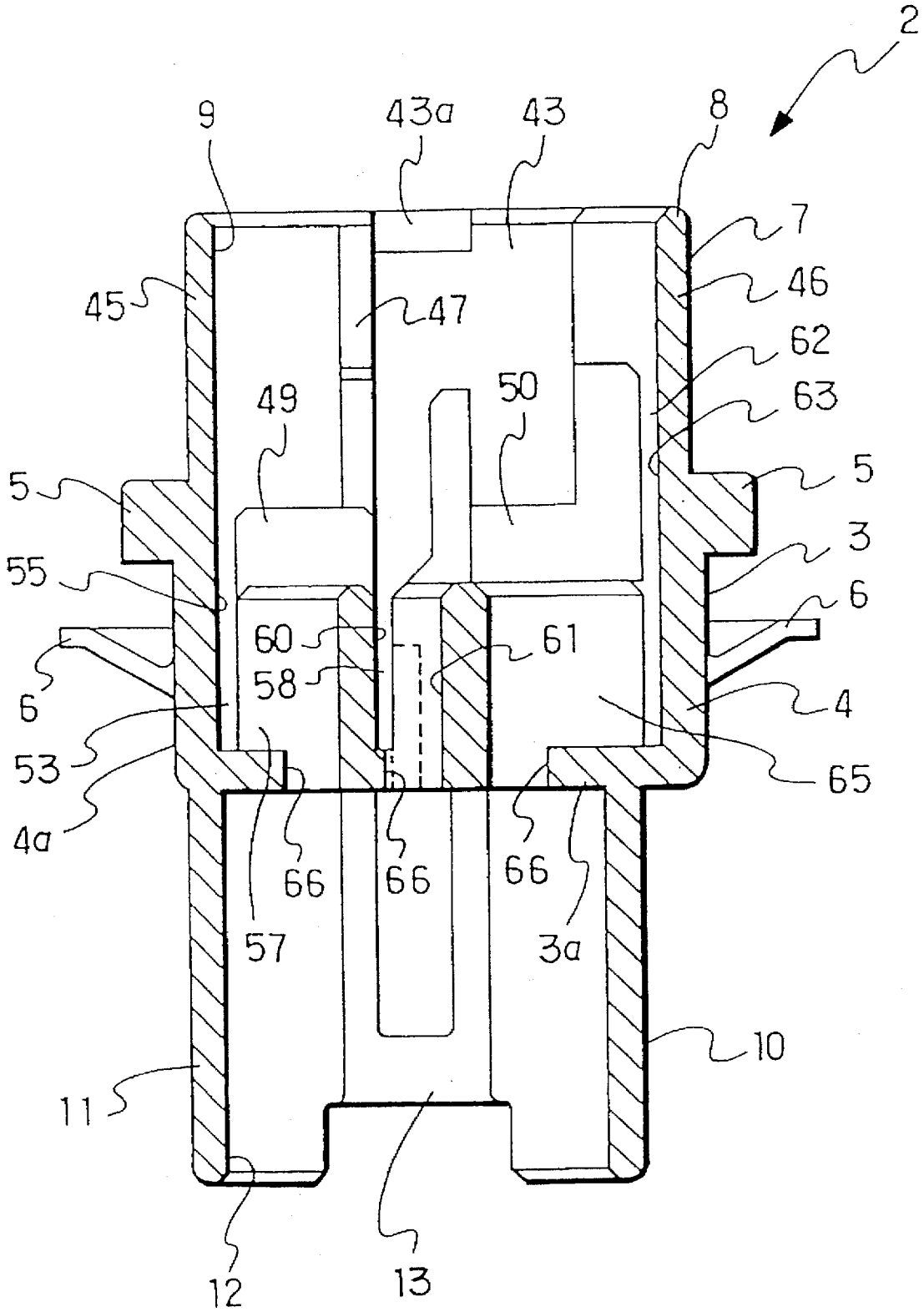
FIG. 6 is a cross-sectional view of the socket body taken along line VI—VI shown in FIG. 4.

Parts of the upper wall 43 and the lower wall 44 situated on the right of the ribs 47 and 48 rise in such a way as to extend to positions before the longitudinal upper and lower edges of the wall 8. In other words, parts of the upper and lower walls are longitudinally formed in an increased thickness compared with the other parts of the wall. Consequently, as shown in FIG. 5, parts of the interior surfaces of the upper wall 43 and the lower wall 44 are cut away, so that cuts 43a and 44a are formed to a certain extent from the rim of the opening of the bulb insertion hole 9.

Block-shaped terminal strip holding sections 49 and 50 are formed in the forward direction on both sides of the rib 47 of the upper wall 43 of the wall 8 so as to extend from the rear end wall 3a of the main portion 3 to a length of about two-thirds the longitudinal length of the bulb socket 7. Similarly, block-shaped terminal strip holding sections 51 and 52 are formed on both sides of the rib 48 of the lower wall 44.

A slit, which can be roughly divided into three subdivisions, is formed between the terminal strip holding sections 49, 50, 51, and 52 and the interior surface 8a of the wall 8.

Figure 4:
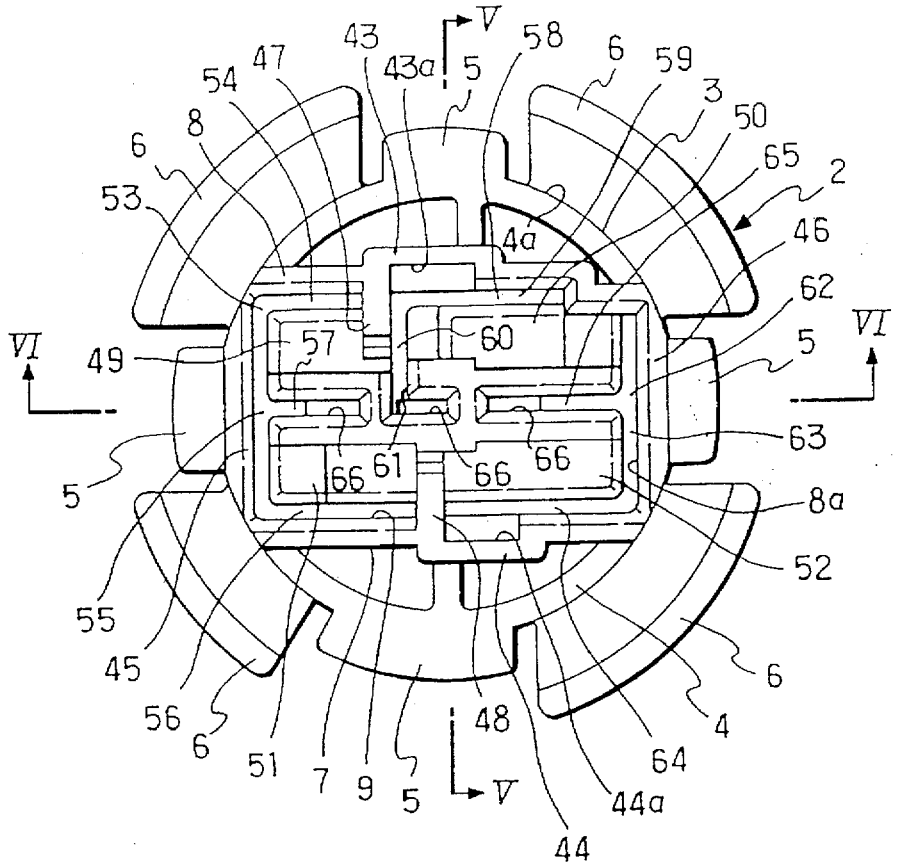
FIG. 4 is a front view of a socket body.

As shown in FIG. 4, a first slit 53 has an upper portion 54 which extends leftward from the left side of the rib 47 raised from the upper wall 43 of the wall 8 to the left wall 45, a vertical portion 55 which extends downward at a right angle from the left edge of the upper portion 54 to the lower wall 44 along the left wall 45, a lower portion 56 which extends at a right angle from the lower edge of the vertical portion 55 to the rib 48 along the lower wall 44, and an intermediate portion 57 which horizontally extends from substantially the middle of the vertical portion 55 in the rightward direction. The upper, lower, and middle portions 54, 56, and 57 are substantially parallel to each other.

A second slit 58 has an upper portion 59 which extends rightward from the rib 47 raised from the upper wall 43 of the wall 8 to the vicinity of the right wall 46, a vertical portion 60 which extends downward at a right angle from the left edge of the upper portion 59 to substantially the diametrical center of the bulb insertion hole 9 along the right side of the rib 47, and a lower portion 61 which extends horizontally at a right angle from the lower edge of the vertical portion 60.

A third slit 62 has a vertical portion 63 which extends from the upper wall 43 to the lower wall 44 along the right wall 46 of the wall 8, a lower portion 64 which extends at a right angle from the lower edge of the vertical portion 63 to the left of the rib 48 along the lower wall 44, and an intermediate portion 65 which extends leftward from substantially the longitudinal middle of the vertical portion 63.

As shown in FIG. 4, when the socket body 2 is viewed in the forward direction thereof, the terminal strip holding section 49 is located below the upper portion 54 of the slit 53, the terminal strip holding section 51 is situated above the lower portion 56, the terminal strip holding section 50 is situated below the upper portion 59 of the slit 58, and the terminal strip holding section 52 is situated above the lower portion 64 of the slit 62. The slits 53, 58, and 62 formed within the bulb insertion hole 9 of the bulb socket 7 have substantially the same configuration as the terminal strips 14, 23, and 31 when viewed in the forward direction thereof.

The intermediate portion 57 of the slit 53, the lower portion 61 of the slit 58, and the intermediate portion 65 of the slit 62 are horizontally arranged in line with each other substantially at the vertical center of the bulb insertion hole 9. Part of the intermediate portion 57, the lower portion 61, and the intermediate portion 65 are connected to insert apertures 66 opening in the connector insertion hole 12 of the power feeding connector section 10 through the rear surface 3a of the main portion 3.

The attachment of the terminal strips 14, 23, and 31 to the socket body 2 will now be described.

The power feeding terminals 22, 30, and 42, also serving as the rear ends of the respective terminal strips 14, 23, and 31, are brought into alignment with respective ones of the insert apertures 66 formed in the rear end wall 3a of the main portion 3 that closes the rear end of the bulb insertion hole 9 of the socket body 2. The terminal strips 14, 23, and 31 are respectively inserted into the first slit 53, the second slit 58, and the third slit 62 within the bulb insertion hole 9 from the front to the rear of the socket body 2.

More specifically, as a result of the first terminal strip 14 being inserted into the slit 53, the main portion 15, the socket terminal section 16, the socket terminal section 17, the power feeding terminal section 21, and the power feeding terminal 22 are inserted into the vertical portion 55, the upper portion 54, the lower portion 56, the intermediate portion 57, and the insert aperture 66, respectively.

As a result of the second terminal strip 23 being inserted into the slit 58, the main portion 24, the joint 28, the power feeding terminal 29, and the power feeding terminal 30 are inserted into the upper portion 59, the vertical portion 60, the lower portion 61, and the insert aperture 66, respectively.

As a result of the third terminal strip 31 being inserted into the slit 62, the main portion 32, the joint 36, the power feeding terminal section 41, and the power feeding terminal 42 are inserted into the lower portion 64, the vertical portion 63, the intermediate portion 65, and the insert aperture 66, respectively.

Accordingly, the socket terminal section 16 of the terminal strip 14 is vertically sandwiched between the wall 8 and the terminal strip holding section 49, and the socket terminal section 17 is also vertically sandwiched between the terminal strip holding section 51 and the wall 8. Consequently, the socket terminal sections are fixedly retained in the bulb insertion hole 9. Similarly, the socket terminal section 25 of the terminal strip 23 is vertically sandwiched between the wall 8 and the terminal strip holding section 50, and the socket terminal section 33 of the terminal strip 31 is vertically sandwiched between the terminal strip holding section 52 and the wall 8. Consequently, the socket terminal sections are fixedly retained in the bulb insertion hole 9.

The terminal strips 14, 23, and 31 are arranged so as to have a positional relationship such as shown in FIG. 1. Specifically, the socket terminal section 16, the holding section 26, and the socket terminal section 25 are spaced at regular intervals in that order from left to right along the upper wall 43 of the wall 8 such that they are positioned close to the left wall 45 as a whole. Similarly, the socket terminal section 17, the holding section 34, and the socket terminal section 33 are spaced at regular intervals in that order from left to right along the lower wall 44 such that they are positioned close to the right wall 46 as a whole. Each one of the pairs of the socket terminal 16a and the socket terminal 17a, the holding piece 26a and the holding piece 34a, and the socket terminal 25a and the socket terminal 33a has a horizontally offset positional relationship with each other. The socket terminal 16a is positioned in front of the terminal strip holding section 49 so as to cover the same, and the holding strip 26a is positioned in front of the terminal strip holding section 50 so as to cover the same. The socket terminal 17a is positioned in front of the terminal strip holding section 51 so as to cover the same, and the socket terminal 33a is positioned in front of the terminal strip holding section 52 so as to cover the same.

Figure 2:
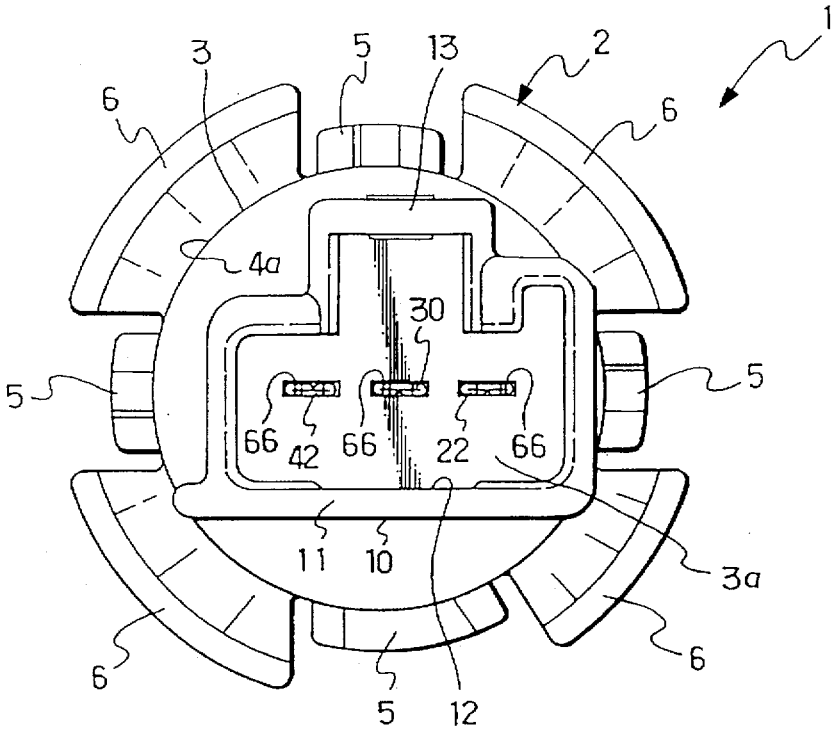
FIG. 2 is a rear view of the wedge-base bulb socket.

As shown in FIG. 2, the plate-like power feeding terminals 22, 30, and 42 of the terminal strips 14, 23, and 31 are laterally arranged in line with each other.

A standard so-called double-filament bulb is used, as a wedge-base bulb 67, which has two filaments 69 and 70 provided within a glass bulb 68.

Leads 71 connected to the filaments 69 and 70 within the glass bulb 68 extend from the rear end of a substantially oblate base 72 formed at the back of the glass bulb 68. The leads 71 are divided into a right lead and a left lead, and they are bent upward and downward along the side of the base 72, respectively. As a result, power feeding terminals 71*a* are formed.

Substantially wedge-shaped regulating protuberances 73 and stopper protuberances 74 are formed on the upper and lower large side surfaces of the base 72 such that they are directed in opposite directions. Specifically, two regulating protuberances 73 are formed on one side, and one stopper protuberance 74 is formed on the same side between the regulating protuberances, whereby they are horizontally aligned to each other. Similarly, these protuberances are also formed at the counterpart position on the other side of the base. When the wedge-base bulb 67 is attached to the bulb insertion hole 9 of the socket body 2, the regulating protuberances 73 come into contact with the interior surface 8*a* of the wall 8. As a consequence, the orientation of the bulb 67 is retained in the intended direction. The stopper protuberances 74 respectively engage the holding piece 26*a* of the terminal strip 23 and the holding piece 34*a* of the terminal strip 31 so as to prevent the wedge-base bulb 67 from becoming dislodged from the bulb socket.

Finally, the attachment of the wedge-base bulb 67 to the wedge-base bulb socket 1 will be described.

As a result of the base 72 of the wedge-base bulb 67 being inserted into the bulb insertion hole 9 of the socket body 2, the wedge-base bulb 67 is retained by the wedge-base bulb socket 1 while being electrically connected to the same.

As previously described, the socket terminal sections 16, 17, 25, and 33 and the holding sections 26 and 34 of the terminal strips 14, 23, and 31 are arranged opposite to each other in a horizontally offset manner. Accordingly, the base 72 of the wedge-base bulb 67 is inserted into the bulb insertion hole 9 while vertically opening up the space between the socket terminals 16*a*, 17*a*, 25*a*, and 33*a* and the holding pieces 26*a* and 34*a*.

Figure 17:
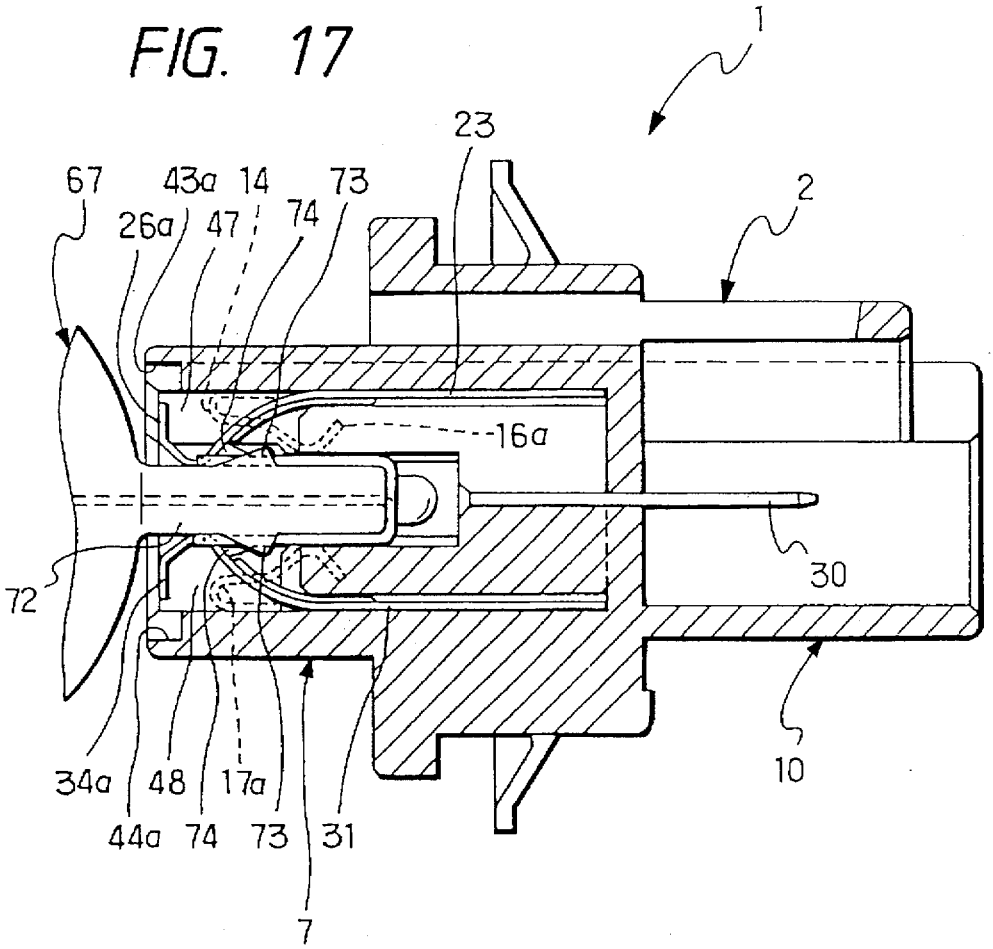
FIG. 17 is a longitudinal cross-sectional view of the wedge-base bulb attached to the wedge-base bulb socket.
Figure 18:
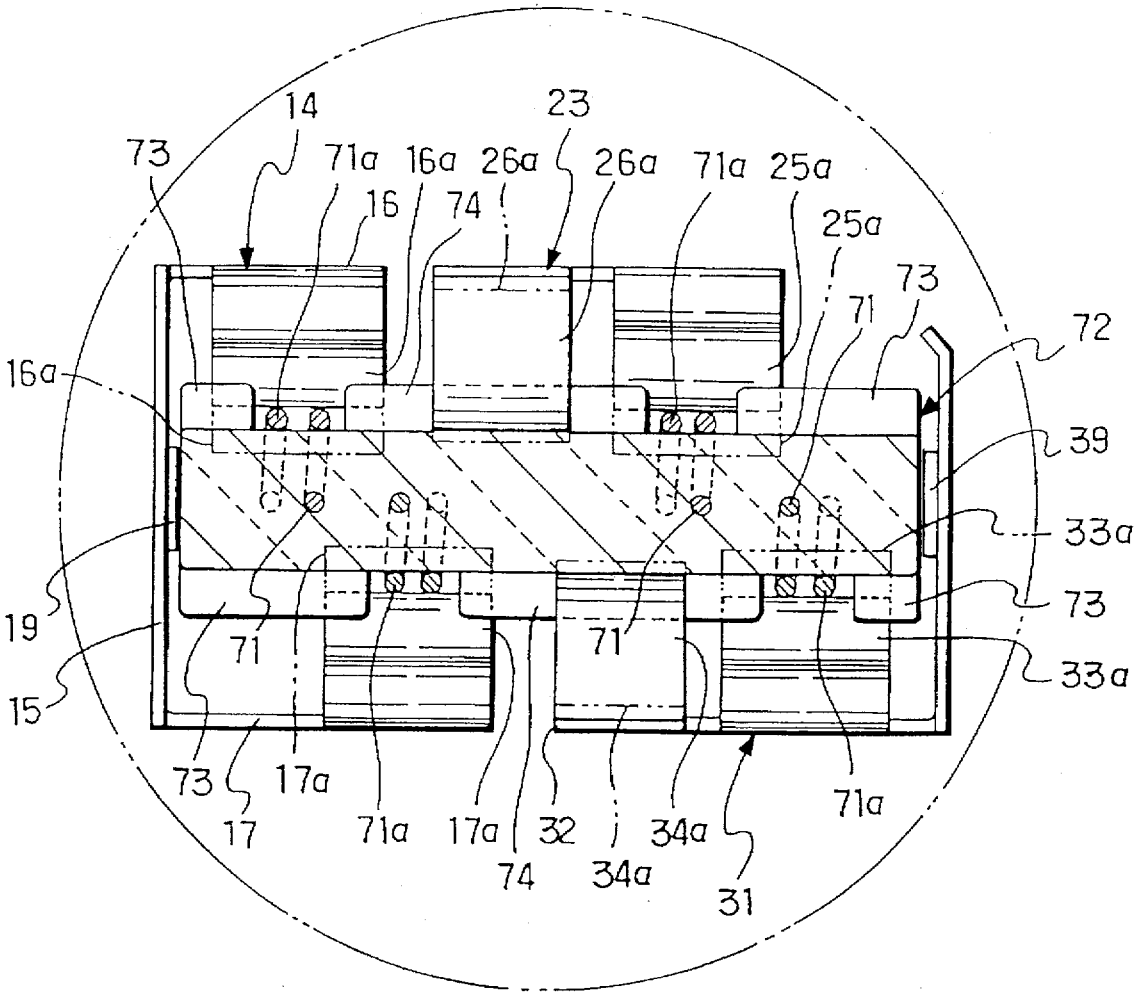
FIG. 18 shows a cross section of the wedge-base bulb attached to the wedge-base bulb socket when viewed from above, diagrammatically showing the relationship between the base of the wedge-base bulb and the terminal strips.
Figure 19:
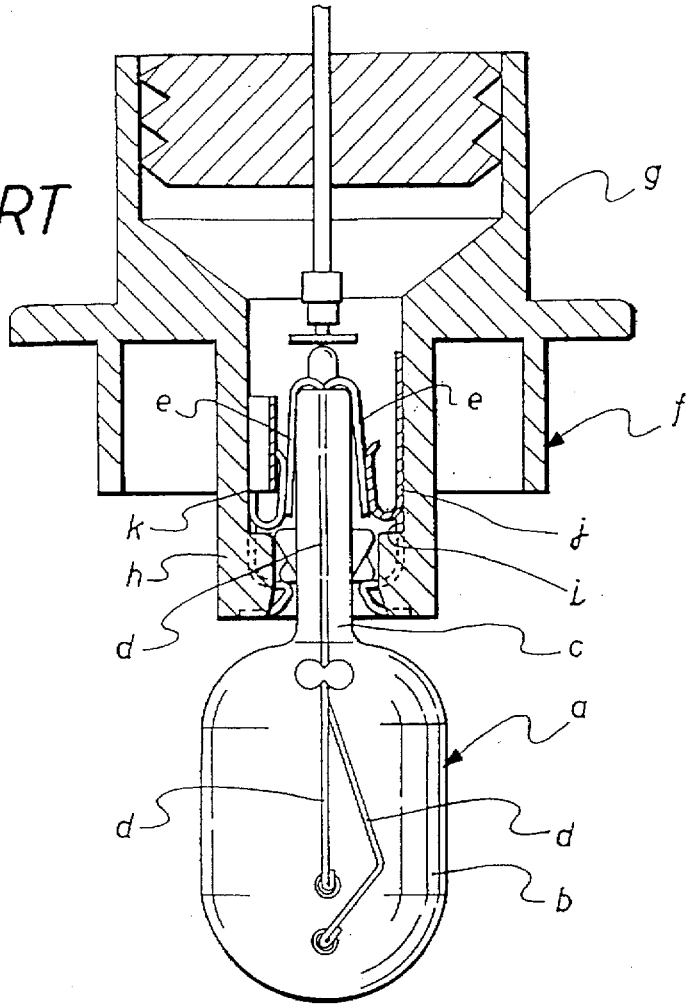
FIG. 19 PRIOR ART
FIG. 19 indicates a horizontal cross section of a conventional wedge-base bulb socket.
Figure 20:
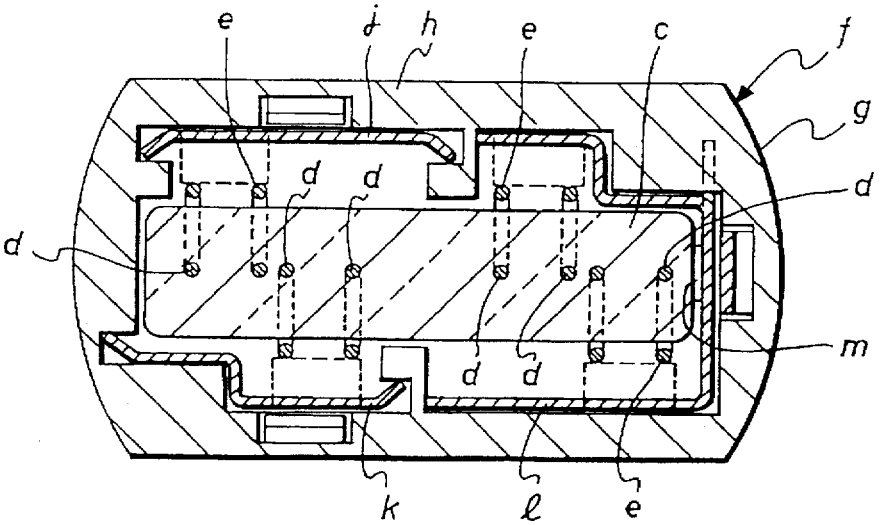
FIG. 20 PRIOR ART
FIG. 20 is a longitudinal cross-sectional view of a bulb retaining section.

When the base 72 is substantially fully inserted into the bulb insertion hole 9, the holding pieces 26*a* and 34*a* of the terminal strips 23 and 31 are positioned in front of the stopper protuberances 74, 74 of the base 72, as shown in FIGS. 17 and 18. As a result, the holding pieces 26*a* and 34*a* engage with the stopper protuberances 74, whereby the wedge-base bulb 67 is prevented from becoming dislodged from the wedge-base bulb socket 1. Simultaneously, the socket terminals 16*a*, 17*a*, 25*a*, and 33*a* of the terminal strips 14, 23, and 31 individually come into contact with the power feeding terminals 71*a*. Specifically, the socket terminals 16*a*, 17*a*, 25*a*, and 33*a* and the holding pieces 26*a* and 34*a* change from the state designated by a two-dot chain line to the state designated by a solid line in FIG. 18. At this time, the base portion 72 of the bulb 67 is forcibly inserted between the holding pieces 26*a* and 34*a*, whereby the spacing between these holding pieces becomes wider. Particularly, when the holding pieces 26*a* and 34*a* go beyond the stopper protuberances 74, 74 of the base portion 72, the spacing between the holding pieces becomes maximum. In this event, the previously described cuts 43*a* and 44*a* formed in the upper and lower walls 43 and 44 prevent the holding pieces 26*a* and 34*a* from interfering with the upper and lower walls 43 and 44.

Further, the base 72 is laterally pressed by the regulating piece 19 of the terminal strip 14 and the regulating piece 39 of the terminal strip 31 within the bulb insertion hole 9. As a result, the base 72 is prevented from moving in the direction in which the filaments 69 and 70 are extended in the bulb 67.

As is evident from the foregoing description, the wedge-base bulb socket of the present invention includes a socket body which is integrally composed of a bulb socket portion and a power feeding socket portion, and at least three terminal strips. A bulb insertion hole is formed in the bulb socket portion opening at one end and surrounded by a wall. Terminal strip holding portions are formed along the interior surface of the wall. The terminal strips are respectively formed by the integration of a socket terminal section for making electrical connection to and holding a base of the wedge-base bulb and a power feeding terminal section for establishing an electrical connection to the outside. The socket terminal sections are disposed within a bulb insertion hole of the bulb socket portion, and the power feeding terminal sections are disposed in a power feeding connector, whereby part of the socket terminal sections are sandwiched between the terminal strip holding portions and the wall.

By means of the wedge-base bulb socket according to the present invention, part of the socket terminals of the terminal strips are sandwiched between the terminal strip holding portions of the bulb socket and the wall. Hence, it is possible to prevent the terminal strips from rattling. Further, rattling of the bulb itself and breakage in the filaments resulting from shaking of the terminal strips is prevented.

Moreover, since the bulb is sandwiched between the terminal strips, the bulb itself is prevented from rattling. Thus, the problem of the luminous intensity distribution pattern of the bulb being disturbed when the bulb is illuminated can be also prevented.

The profiles and structures of the elements disclosed herein are merely illustrative to explain the best mode known of practicing the present invention. As a matter of course, the technical scope of the present invention should not be construed in a limiting sense.

What is claimed is:

1. A wedge-base bulb socket comprising:

a socket body, said socket body comprising a bulb socket portion and a power feeding socket portion integrally formed with one another, a bulb insertion hole being formed in said bulb socket portion, said bulb insertion hole being open at one end, a wall surrounding said bulb insertion hole, and block-shaped terminal strip holding sections formed along an interior surface of said wall; and at least three terminal strips, said terminal strips each comprising a socket terminal section for making electrical connection to and holding a base of a wedge-base bulb and a power feeding terminal section for establishing electrical connection outside said bulb socket, said socket terminal sections being disposed within said bulb insertion hole of said bulb socket portion, and said power feeding terminal sections being disposed in a power feeding connector portion, part of each of said socket terminal sections being sandwiched between said block-shaped terminal strip holding sections and said wall.

2. The wedge-base bulb socket as defined in claim 1, wherein slits are formed in said bulb socket portion for receiving said terminal strips.

3. The wedge-base bulb socket as defined in claim 1, wherein at least two of said terminal strips each comprises at least one regulating piece the base being sandwiched between said regulating pieces to prevent the base from moving in a direction in which filaments of the bulb extend.

4. The wedge-base bulb socket as defined in claim 2, wherein at least two of said terminal strips each comprises at least one regulating piece, the base being sandwiched between said regulating pieces to prevent the base from moving in a direction in which filaments of the bulb extend.

5. The wedge-base bulb socket as defined in claim 1, wherein power feeding terminals of said power feeding terminal sections of said terminal strips are laterally arranged in line with each other.

6. A wedge-base bulb socket comprising:

a socket body molded from a dielectric material, said socket body comprising:

a substantially cylindrical main portion opening in a forward direction and having a rear end closed by a rear end wall;

a substantially parallelepiped bulb socket projecting forwardly from said rear end wall of said main portion for receiving therein a base of a wedge-base, a wall surrounding said bulb socket, a bulb insertion hole being formed in a front end of said bulb socket, and block-shaped terminal strip holding sections formed along an interior surface of said wall; and a substantially cylindrical power feeding connector projecting rearward from said rear end wall, and a wall surrounding said power feeding connector; and at least three terminal strips, said terminal strips each comprising a socket terminal section for making electrical connection to and holding the base of the wedge-base bulb and a power feeding terminal section for establishing electrical connection outside said bulb socket, said socket terminal sections being disposed within said bulb insertion hole of said bulb socket portion, and said power feeding terminal sections being disposed in said power feeding connector portion, part of each of said socket terminal sections being sandwiched between said block-shaped terminal strip holding sections and said wall surrounding said bulb socket, at least two of said terminal strips each comprising at least one regulating piece, the base being sandwiched between said regulating pieces to prevent the base from moving in a direction in which filaments of the bulb extend.

7. The wedge-base bulb socket as defined in claim 6, wherein a first one of said terminal strips comprises: a main portion extending vertically and first and second socket terminal sections projecting from respective upper and lower edges of said main portion, said socket terminal portions projecting to different lengths, and first and second socket terminals extending from ends of said first and second socket terminal sections, respectively, said first and second socket terminals having front ends bent respectively downward and upward in a hairpin shape and extending rearward so as to be arranged in offset relationship with each other in a vertical direction of said main portion.

8. The wedge-base bulb socket of claim 7, wherein the regulating piece of said first of said terminal strips comprises a trapezoidal protuberance, a pair of parallel slits being formed in a vertical middle of said main portion, and an area sandwiched between said slits being raised rightward to form said protuberance.

9. The wedge-base bulb socket of claim 6, wherein a second of said terminal strips comprises: a substantially rectangular parallelepiped main portion, a socket terminal section and a holding section extending side by side from a front edge of said main portion, a socket terminal extending from a front end of said socket terminal section, a joint extending downward from a left edge of a rear of said main portion, and a power feeding terminal section extending from a lower edge of said joint, said socket terminal being bent downward in a hairpin shape, said holding section being bent downward, and a front distal end of said holding section being bent upward to form a hook-shaped holding piece.

10. The wedge-base bulb socket of claim 9, wherein a third of said terminal strips comprises: a substantially rectangular parallelepiped main portion, a socket terminal section and a holding section extending side by side from a front edge of said main portion, a socket terminal extending from a front end of said socket terminal section, a joint extending downward from a left edge of a rear of said main portion, and a power feeding terminal section extending from a lower edge of said joint, said socket terminal being bent upward in a hairpin shape, said holding section being bent upward, and a front distal end of said holding section being bent downward to form a hook-shaped holding piece.

11. The wedge-base bulb socket of claim 10, wherein the regulating piece of said first of said terminal strips comprises a trapezoidal protuberance, a pair of parallel slits being formed in a vertical middle of said main portion, and an area sandwiched between said slits being raised rightward to form said protuberance.

12. The wedge-base bulb socket of claim 6, wherein said bulb socket comprises an upper wall, a lower wall, a left wall and a right wall together defining said bulb insertion hole, slits extending forward from said rear end wall of said main portion along interior surfaces of said upper, lower, left and right walls for retaining said terminal strips, and a pair of ribs rising from interior surfaces of said upper and lower walls.

13. The wedge-base bulb socket of claim 12, comprising a pair of said block-shaped terminal strip holding sections on opposite sides of each of said pair of ribs.

14. The wedge-base bulb socket of claim 6, wherein slits are formed in said bulb socket conforming in configuration to respective ones of said terminal strips.

* * * * *